US009677216B2

(12) United States Patent
Ertel et al.

(10) Patent No.: US 9,677,216 B2
(45) Date of Patent: Jun. 13, 2017

(54) LAUNDRY DRYER HAVING A HEAT EXCHANGER

(71) Applicant: BSH Bosch und Siemens Hausgeräte GmbH, Munich (DE)

(72) Inventors: Marcin Ertel, Lodz (PL); Marek Gasieniec, Lódz (PL); Tomasz Suwalski, Lódz (PL); Jaroslaw Tazbir, Piotrków T. (PL)

(73) Assignee: BSH Hausgeräte GmbH, Munich (DE)

( * ) Notice: Subject to any disclaimer, the term of this patent is extended or adjusted under 35 U.S.C. 154(b) by 476 days.

(21) Appl. No.: 13/903,015

(22) Filed: May 28, 2013

(65) Prior Publication Data

US 2014/0352166 A1 Dec. 4, 2014

(51) Int. Cl.

| | |
|---|---|
| ***D06F 58/24*** | (2006.01) |
| ***D06F 58/20*** | (2006.01) |
| ***D06F 58/02*** | (2006.01) |

(52) U.S. Cl.

CPC ..... *D06F 58/24* (2013.01); *D06F 58/02* (2013.01); *D06F 58/20* (2013.01); *D06F 58/206* (2013.01)

(58) Field of Classification Search

CPC ..... D06F 58/02; D06F 58/20; D06F 58/24; D06F 58/206

USPC ..... 34/603, 604, 606, 608, 609, 610, 134; 110/348, 308

See application file for complete search history.

(56) References Cited

U.S. PATENT DOCUMENTS 3,419,969 A * 1/1969 Freze ..... D06F 58/02 34/126
5,257,468 A * 11/1993 Lebrun ..... D06F 58/00 34/235
6,966,268 B2 * 11/2005 Kim ..... F23L 15/00 110/348
2007/0193058 A1 * 8/2007 Zarembinski ..... D06F 58/10 34/202
2008/0196268 A1 * 8/2008 Jung ..... D06F 58/20 34/85
2009/0320319 A1 * 12/2009 Grunert ..... D06F 58/28 34/467

(Continued)

FOREIGN PATENT DOCUMENTS

DE 102009030286 A1 2/1952
EP 1832678 A1 9/2007

(Continued)

OTHER PUBLICATIONS

Partial English Machine Translation: JP 06063294. Accessed Mar. 19, 2016.*
National Search Report EP 14 16 8788 dated Oct. 2, 2014.

*Primary Examiner* — Kenneth Rinehart
*Assistant Examiner* — Tavia Sullens
(74) *Attorney, Agent, or Firm* — Jordan IP Law, LLC; Todd A. Vaughn

(57) ABSTRACT

A laundry dryer includes a body having air discharge openings in an upper region, a clothes drum disposed in the body, and a heat exchanger to condense process air from the drum. The heat exchanger is positioned in the body below the drum and has a cooling air outlet. Further provided is an air duct having an air inlet which is connected to the cooling air outlet and an air outlet which is positioned above the heat exchanger. The air duct is arranged to discharge cooling air from the air outlet in an upward direction into the body.

13 Claims, 5 Drawing Sheets

(56) References Cited

U.S. PATENT DOCUMENTS

| | | | | |
|---|---|---|---|---|
| 2012/0000087 | A1* | 1/2012 | Da Riol | D06F 58/20<br>34/108 |

FOREIGN PATENT DOCUMENTS

| | | | | |
|---|---|---|---|---|
| JP | 06063294 | A | * | 3/1994 |
| KR | 20050017282 | A | | 2/2005 |
| WO | 2011154439 | A1 | | 12/2011 |

* cited by examiner

LAUNDRY DRYER HAVING A HEAT EXCHANGER

BACKGROUND OF THE INVENTION

The present invention relates to a laundry dryer.

During a drying cycle of a laundry dryer, lint is typically released from the clothes and may, in small quantities, end up in the body of the laundry dryer. There, it mostly deposits on a floor or bottom. Over a lifetime of the laundry dryer, the lint is likely to accumulate. Lint is potentially flammable and might, under extreme conditions, be ignited within the body.

Document WO 2011/154439 A1 relates to a dryer including a body having two side walls, a front wall and a rear wall, a drum disposed in the body, into which the laundry to be dried is placed, a condenser providing the dehumidification of the cooling air used in the drying process by condensing it, a base unit disposed under the drum, supporting the motor, the fan, the condenser and other elements required for the drying process, a first opening disposed on the base unit, providing the cooling air passing through the condenser to be delivered into the body, a second opening disposed on the rear wall, providing the cooling air delivered into the body to be discharged to the outer environment, and wherein vibration and noise occurring during the discharge of the cooling air passed over the condenser to the outer environment are reduced.

BRIEF SUMMARY OF THE INVENTION

It would therefore be desirable and advantageous to provide an improved laundry dryer which obviates prior art shortcomings and which is capable of reducing risk of self-combustion of lint accumulated on the floor of a laundry dryer and of containing or preventing fire within or coming out of the dryer caused by self-combustion of lint accumulated on the floor of the dryer, while still being simple in structure and cost-effective manner. It would also be desirable and advantageous to improve process performance in a simple and cost-effective manner and to improve noise performance in a simple and cost-effective manner.

According to one aspect of the invention, a laundry dryer includes a body having air discharge openings in an upper region, a clothes drum disposed in the body, a heat exchanger to condense process air from the drum, the heat exchanger being positioned in the body below the drum and having a cooling air outlet, and an air duct having an air inlet connected to the cooling air outlet and an air outlet which is positioned above the heat exchanger, the air duct being arranged to discharge cooling air from the air outlet in an upward direction into the body.

Thus, by virtue of the air duct, cooling air is not being discharged in the vicinity of the floor or bottom anymore but is discharged into the body at a significant distance above the floor, and away from the floor. This discharged air can escape the body through the air discharge openings in the upper region so that the discharged air is not re-directed towards the floor. Thus lint accumulated on the floor is not aerated by the cooling air which mitigates the spreading of fire or flames through the lint. Additionally, burning lint is not being carried away by the cooling air into other regions of the dryer or through air discharge openings. Also, such an air duct can be realized in a cost-effective manner. In particular, the other components of the dryer do not need to be significantly adapted or changed, if at all. Further, the air duct can achieve noise reduction and can improve process performance in a simple and cost-effective manner.

According to another advantageous feature of the present invention, the laundry dryer can be constructed as a tumble dryer having a rotatable drum. The rotatable drum may be actuated or driven by a motor. This motor may in particular be positioned on the floor of the dryer.

According to another advantageous feature of the present invention, the laundry dryer can be a 'front loading dryer' having a loading port in a front side of the dryer. In particular if the front loading dryer is a tumble dryer, the drum may be rotatable around a horizontal rotation axis. The drum may in particular be rotatably attached to a first bearing shield at the front and/or a second bearing shield at the rear.

According to another advantageous feature of the present invention, the body or housing may include a front panel (or "wall" or "side"), two side panels, and a rear panel. The front panel may include an opening for the loading port. The air discharge openings of the body are advantageously located at the rear panel, in particular solely at the rear panel.

According to another advantageous feature of the present invention, the air discharge openings can be mainly located in an upper region of the body. Advantageously, the air discharge openings representing at least 80%, preferably 90%, preferably 100%, of a cross-sectional area of all air discharge openings may be located in an upper region of the body. The other air discharge openings, if any, may be located in a complementary lower region of the body. Thus, in one embodiment, all air discharge openings may be located in an upper region of the body. In the event of a self-combustion of lint, this prevents that oxygen-rich ambient air is supplied to the floor region in great quantities thus slowing a spread of flames and/or preventing a stack-effect.

An "upper region" of the body may in particular relate to a region that is located at least within the upper ⅔ of the height of the body. In other words, the air discharge openings are mainly (i.e. representing at least 80%, preferably 90%, preferably 100%, of a cross-sectional area) located above at least ⅓ of the height of the body starting from the floor or bottom.

The heat exchanger may in particular be an air/air heat exchanger having a first air channel to guide cooling air and a second air channel to guide process air to enable a thermal exchange between the cooling air and the process air. The heat exchanger may thus in particular include a cooling air inlet, a cooling air outlet, a process air inlet, and a process air outlet. Since the process air coming from the drum is typically warmer than the cooling air, heat is transferred from the process air to the cooling air so that the process air is cooled down and moisture of the cooling air is condensed. The heat exchanger can thus also be regarded as an air-cooled process air condenser.

According to another advantageous feature of the present invention, the laundry dryer includes a closed-loop process air channel that re-circulates process air from and to the drum. The process air channel includes or is functionally connected to the heat exchanger. Additionally, the process air channel may include or may be functionally connected to a ventilator or fan for moving the process air within the process air channel and/or a heating means downstream of the heat exchanger for heating the condensed process air prior to re-entering the drum.

The heat exchanger may be positioned below the drum as a stand-alone device. Advantageously, the heat exchanger can be made part of a base unit or base module. The base unit may additionally include other functional elements for operating the dryer such as the motor for rotating the drum, the ventilator or fan, a condensate reservoir, etc. The functional elements may be attached to a common mounting, e.g. a mounting frame. The base unit may include plastic parts. Lint will then typically accumulate on the base unit. The base unit may be regarded as the floor of the body interior.

The cooling air outlet of the heat exchanger is connected to the air inlet of the air duct and advantageously has an airtight connection between the cooling air outlet of the heat exchanger and the air inlet of the air duct to prevent leakage. To this effect, the cooling air outlet and/or the air inlet may include a sealing.

According to another advantageous feature of the present invention, the body has a front panel, two side panels, and a rear panel, with the discharge openings of the body being located in an upper region of the rear panel, and with the air duct being arranged to discharge cooling air along one of the side panels. As a result, a conventional position of the discharge openings and of the heat exchanger can be maintained which reduces an adaptation effort for integrating the air duct. The aeration and transport of burning lint by the cooling air can thus effectively be prevented in a particularly cost-saving manner.

According to another advantageous feature of the present invention, the air duct can be arranged to discharge cooling air between the one of the side panels and the clothes drum. As a result, a high volume of cooling air can directly flow into a region within the body above the drum and spread there. The drum then acts as a bather to prevent this cooling air from flowing back down towards the floor or bottom of the body in large quantities. Therefore, this cooling air can effectively flow from this region through the discharge openings and out of the body.

According to another advantageous feature of the present invention, the air duct can be arranged to create a flow of cooling air substantially parallel along the one of the side panels. This enables a strong laminar air flow between the drum and the side panel without blowing onto the drum. Thus, the drum is not significantly cooled by the cooling air which in turn increases the process performance and energy efficiency. Also, the side panel is not or not significantly hit or stressed by the cooling air which reduces noise, e.g. caused by vibrations of the side panel. This embodiment is advantageous when the laundry dryer is constructed in the form of a front-loading laundry dryer having a horizontally aligned drum since such a drum is a particularly effective air barrier.

The term "substantially parallel" may relate to "parallel" or "slightly inclined". "Slightly inclined" may in particular relate to an inclination having an inclination angle (e.g. with the side panel) of less than 25°, in particular of less than 10°, in particular of less than 5%. An inclination angle of 0° indicates a parallel alignment.

To keep the cooling air flow so narrow that it is not significantly directed onto the drum but mostly into the gap between the drum and the side panel, the at least one air outlet of the air duct can be inclined towards the side panel. This may lead to an air flow of cooling air discharged from the at least one air outlet that is inclined towards the side panel. In particular, the inclination angle is less than 60°, in particular less than 45°. Generally, an inclination angle of the air outlet may be larger than an inclination angle of the discharged air flow.

Advantageously, the cooling air discharged from the air duct is at least substantially laminar. This avoids turbulences that could aerate the lint. Also a warm air around the drum is not significantly disturbed to maintain energy effectiveness.

According to another advantageous feature of the present invention, the at least one air outlet of the air duct may have a height between 20 mm and 40 mm. Currently preferred is a height of 30 mm.

According to another advantageous feature of the present invention, the air duct can have a height between 200 mm and 300 mm. This is a particular effective to prevent lint to be aerated by the cooling air which at the same time is easy to integrate into the dryer. The height of the air duct is in particular an effective height or functional height between its air inlet and its air outlet and thus the height that the cooling air is travelling between the air inlet and the air outlet. The air duct as a device may have a greater overall height, e.g. because of projecting fastening means etc. Thus, the air duct preferably guides cooling air from the level of the heat exchanger to a level between 200 mm and 300 mm further upwards.

Advantageously, the air duct has a (effective) height between 200 mm and 250 mm. Currently preferred is a height of 220 mm.

According to another advantageous feature of the present invention, the laundry dryer can be constructed in the form of a front-loading laundry dryer having a horizontally aligned drum, with the air outlet of the air duct being located between the drum and a side panel of the body below a largest width of the drum, and with the air discharge openings being located above the largest width of the drum. This enables a particular effective way to use the drum as an air flow barrier while allowing easy assembly of the air duct.

Alternatively, the air duct may reach through the gap between the drum at its largest width and the side panel such that the air outlet is located above the largest width of the drum. This may be a particularly effective way to prevent back-flow of the cooling air to the floor, in particular to a base unit.

According to another advantageous feature of the present invention, the discharge openings of the body can be mainly positioned in an upper half of the body, i.e. in the upper half of the height. In other words, the discharge openings of the body are mainly positioned above a half of the height of the body or panel.

According to another advantageous feature of the present invention, the discharge openings of the body can be mainly, in particular solely, located in an upper 40% of a height of the body.

It is yet another preferred embodiment that the at least one air outlet of the air duct is located not more than 50 mm below the discharge openings of the body. Preferably the at least one air outlet of the air duct is located no more than 10 mm below the discharge openings opening of the body.

According to another advantageous feature of the present invention, a cross-sectional area of the at least one air outlet of the air duct can be equal or greater than a cross-sectional area of the air inlet of the air duct. This prevents the cooling air flowing through the air duct from gaining speed at the air outlet which might cause a whistling sound. Thus, this embodiment helps with noise reduction or prevention.

According to another advantageous feature of the present invention, the air duct may be made of one piece or may be a preassembled, multiple-piece device. The air duct is preferably made of plastic, e.g. made by die casting.

BRIEF DESCRIPTION OF THE DRAWINGS

A non-limiting preferred embodiment of the present invention will now be explained in greater detail by reference to and in conjunction with the Figures of the accompanying drawing.

DETAILED DESCRIPTION OF EXEMPLARY EMBODIMENTS OF THE PRESENT INVENTION

Figure 1:
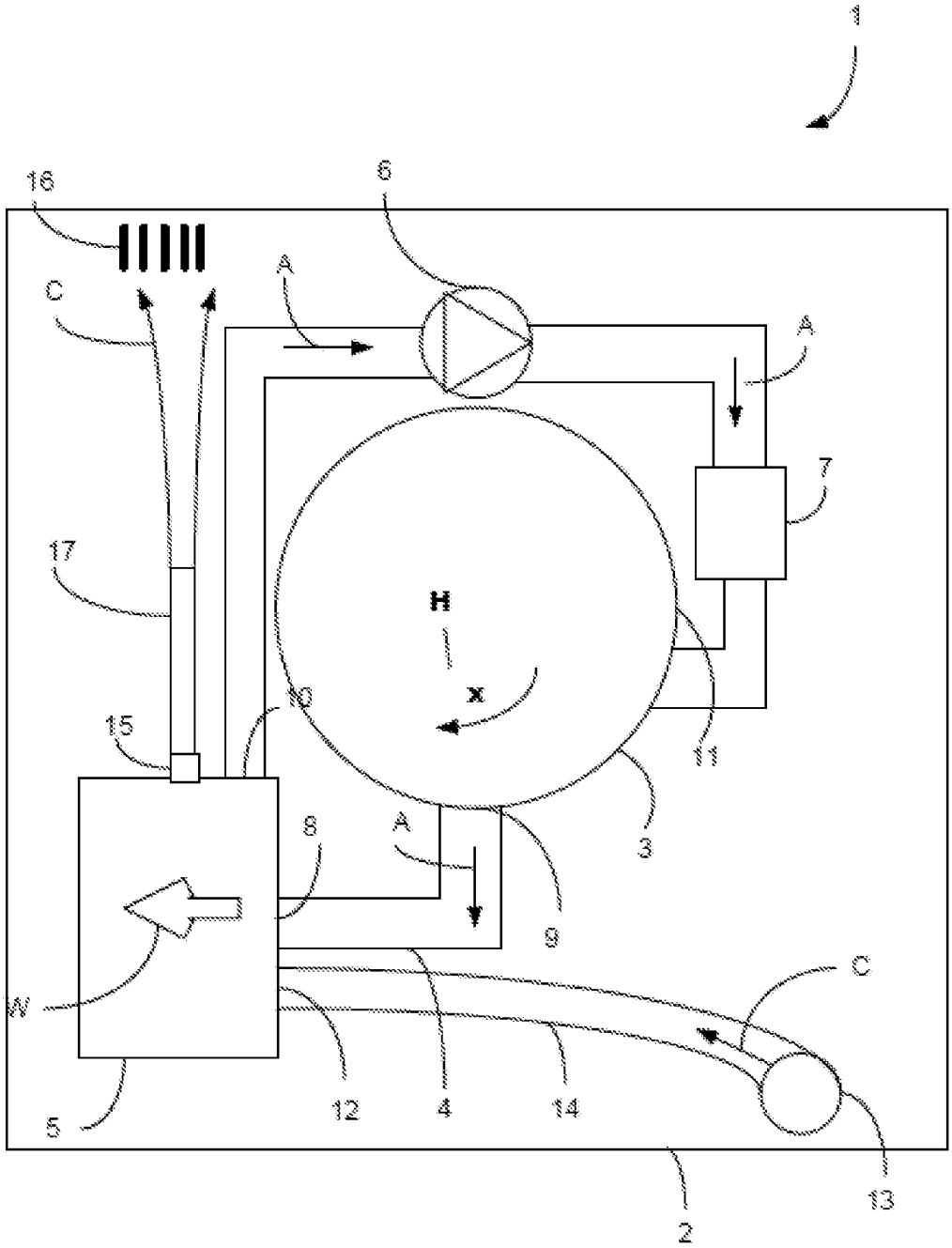
FIG. 1 shows a sketch of selected parts of a tumble dryer for drying laundry.

FIG. 1 shows a sketch of selected parts of a tumble dryer 1 for drying laundry. The tumble dryer 1 comprises a housing or body 2, in which resides a rotatable drum 3. The drum 3 is a front-loadable drum that rotates around a horizontal axis H. The drum 3 is connected to and part of a closed-loop process air channel 4 that re-circulates process air A from and to the drum 3. The process air channel 4 comprises a condenser in form of a heat exchanger 5 for cooling the process air A. The process air channel 4 also comprises a ventilator 6 or fan for moving the process air A within the process air channel 4 and comprises a heating means 7, e.g. an electric heater, downstream of the heat exchanger 5 for heating the process air A prior to re-entering the drum 3.

During operation of the tumble dryer 1, the drum 3 is loaded with wet clothes (not shown). The heating means 7 creates warm and dry process air A that flows into the rotating drum 3. By means of the warm and dry process air A, moisture can evaporate from the clothes. The resulting warm and moisture-rich process air A flows out of the drum 3 into the heat exchanger 5. In the heat exchanger 5, the process air A is cooled down, and the moisture is condensed. Downstream of the heat exchanger 5, the process air A is again dry and comparatively cool. This dry and (comparatively) cool process air A then flows again to the heating means 7, and the circle starts anew.

To cool down the process air A in the heat exchanger 5, not only the process air A flows through the heat exchanger 5 but also cooler cooling air C. The process air A and the cooling air C do not mix within the heat exchanger 5 but are thermally coupled such that heat W from the process air A is transferred to the cooling air C in significant quantities. The cooling air C is provided from ambient air outside the body 2. Thus, the heat exchanger 5 comprises a process air inlet 8 connected to an outlet port 9 of the drum 3, a process air outlet 10 connected to an inlet port 11 of the drum 3 via the ventilator 6 and the heating means 7, a cooling air inlet 12 connected to an air intake port 13 of the body 2 via an air intake duct 14, and a cooling air outlet 15 opening into the body 2. During operation, ambient air is sucked into the air intake port 13 of the body 2 (e.g. by a ventilator or fan, not shown) and flows through the air intake duct 14 to the cooling air inlet 12 of the heat exchanger 5, through the heat exchanger 5 and is then discharged through the cooling air outlet 15. To discharge air from the body 2, the body 2 comprises multiple air discharge openings 16.

In a tumble dryer according to the prior art, the cooling air outlet 17 directly opens into the body 2 such that the cooling air C blows onto or closely next to lint (not shown) that has been accumulated on a floor or bottom of the tumble dryer. Thus, in the case of self-combustion, burning lint is aerated and may further be blown around the body 2 and possibly out through the discharge openings 16 by the cooling air C discharged from the cooling air outlet 15.

To overcome this disadvantage, the tumble dryer 1 shown has an (inner) air duct 17 connected to the cooling air outlet 15 that guides the cooling air C discharged from the cooling air outlet 15 to a region of the body 2 where it does not adversely affect burning lint anymore.

Figure 2:
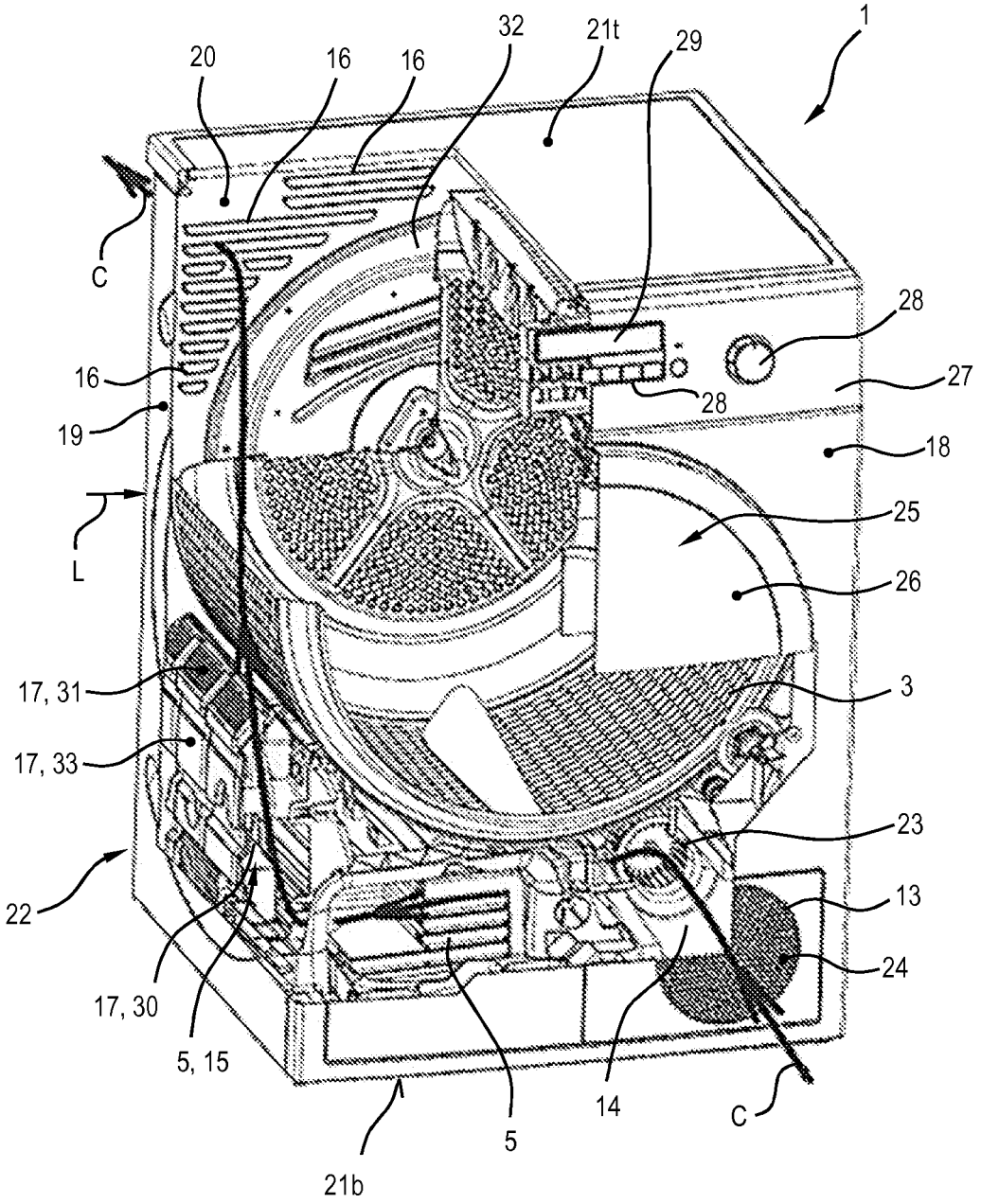
FIG. 2 shows an oblique view of a partial cut-out of a more detailed representation of the laundry dryer of FIG. 1.

FIG. 2 shows an oblique view of a partial cut-out of a more detailed representation of the tumble dryer 1.

The body 2 comprises a front panel 18, two side panels of which a left side panel 19 is shown, a rear panel 20, a top side 21*t*, and a bottom side 21*t*. The bottom side 21*b* is covert by a base unit 22 that, inter alia, comprises the heat exchanger 5, the air intake duct 14, a radial fan 23, a motor for rotating the drum 3 (not shown). The radial fan 23 is used for moving the cooling air C from the air intake port 13 of the body 2 through the air intake duct 14 to the heat exchanger 5. The air intake port 13 is covered by a mesh 24.

The tumble dryer 1 further comprises a loading port 25 in the front panel 18 for loading the clothes into the drum 3, a door 26 for closing the loading port 25, a control panel 27 having several control elements 28 and a display 29. At the rear, the drum 3 is rotatably attached to a bearing shield 32.

The air discharge openings 16 are formed as horizontal slots and are located at the rear panel 20. In particular, all air discharge openings 16 are located in an upper 40% of the height of the body 2 and of the rear panel 20, respectively. Thus, the air discharge openings 16 are also positioned above the largest width L of the drum 3. They are further located around the bearing shield 32.

The cooling air outlet 15 of the heat exchanger 5 is located on an upper side of the heat exchanger 5 and below the drum 3. The air duct 17 is attached to the heat exchanger 5 in such a way that its air inlet 30 is pressed onto the cooling air outlet 15 of the heat exchanger 5 in an airtight manner. Alternatively, the air inlet 30 and the air outlet 15 are spaced apart in an airtight manner against the surrounding top area of the base unit 22. Cooling air C flows upwards through the air duct 17 in a substantially vertical direction and exits the air duct 17 at an air outlet 31. The air duct 17 is located below the largest width L of the drum 3 and substantially above the base unit 22. Its air outlet 31 is located between a lower half of the drum 3 and the left side panel 19, facing the left side panel 19 in an oblique manner.

Figure 3:
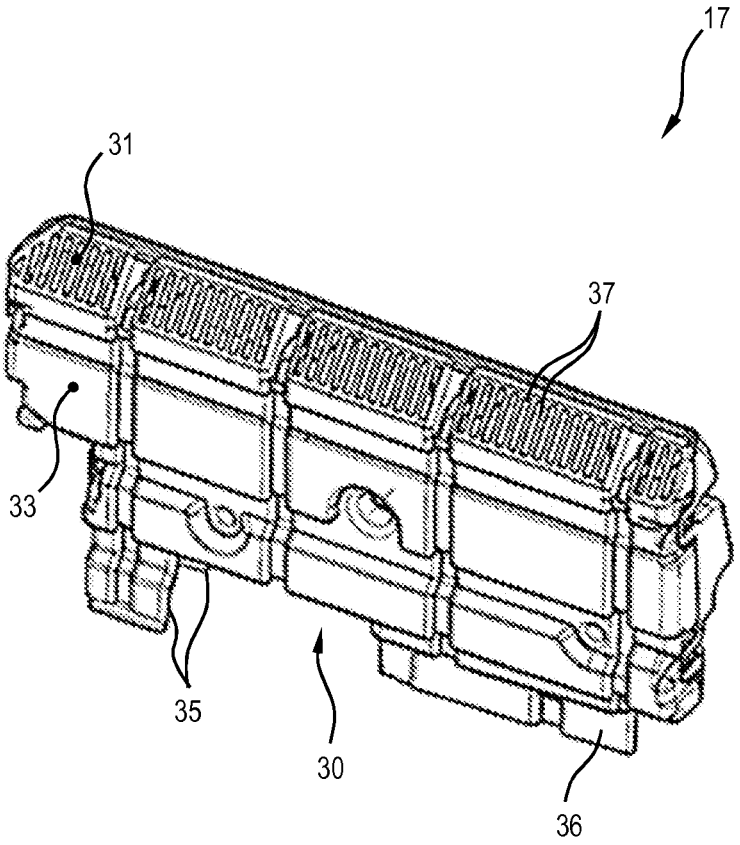
FIG. 3 shows an oblique view onto a front side of an inner air duct of the laundry dryer of FIG. 2.
Figure 4:
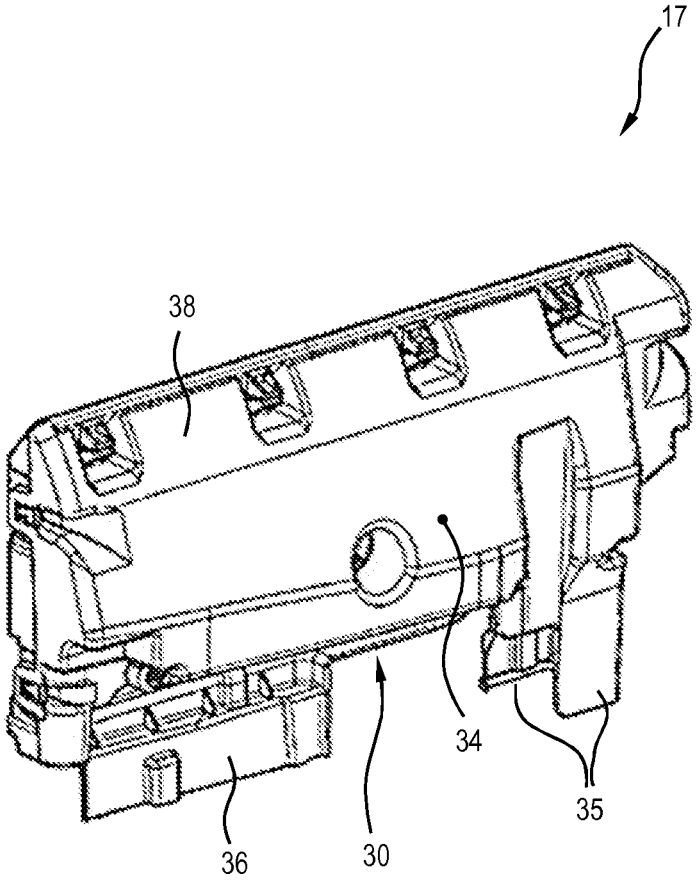
FIG. 4 shows an oblique view onto a rear side of the inner air duct of FIG. 3.
Figure 5:
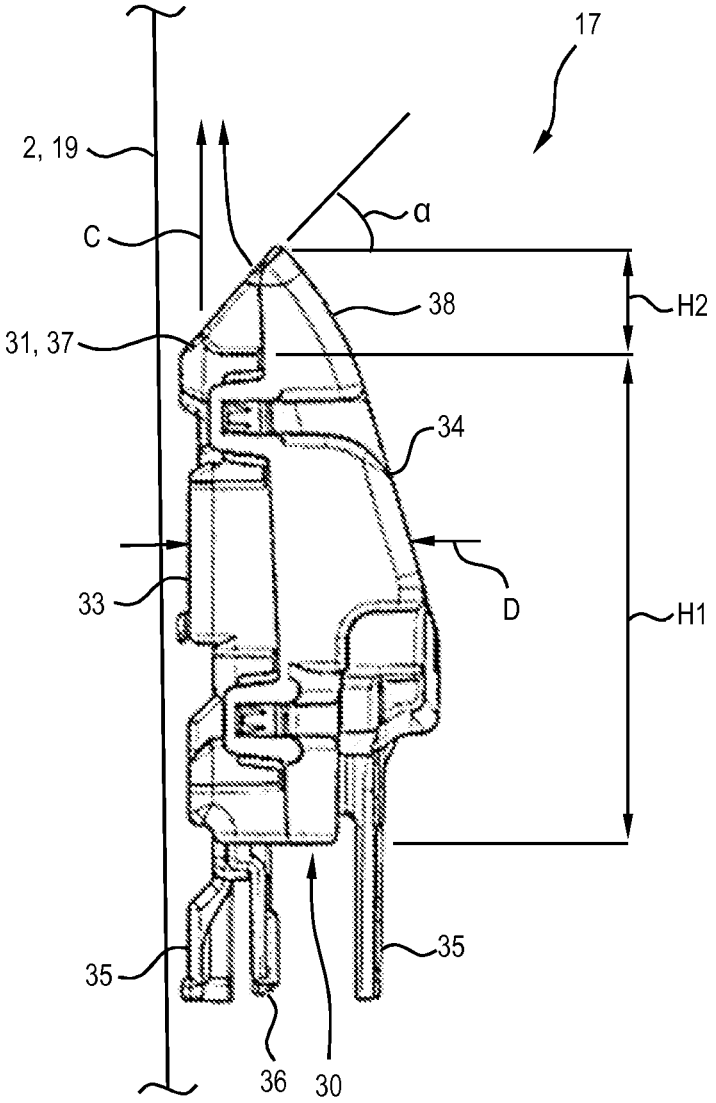
FIG. 5 shows a side view of the inner air duct of FIG. 3.

The air duct 17 is shown in greater detail in FIG. 3 with view onto a front side 33, FIG. 4 with view onto a rear side 34, and FIG. 5 as a side view with air duct 17 being located next to the left side panel 19. The air duct 17 is of a roughly cuboid shape and made of plastic. The air inlet 30 is located at a bottom side of the air duct 17. From the bottom side are protruding a clip 35 and a plate 36 to attach the air duct 17 to the heat exchanger 5. As shown in FIG. 5, the air duct 17 has an effective height H1 for guiding the cooling air C about 220 mm in an upward direction. A height H2 of the air outlet 31 is about 30 mm. Because the air duct 17 is laterally closed along its effective height H1, the cooling air C flows from the level of the heat exchanger 5 to a level 220 mm higher.

The air outlet 31 comprises a horizontal series of vertically aligned slots 37. The air outlet 31 and its vertically aligned slots 37, respectively, are inclined towards the left side panel 19 by an inclination angle $\alpha$ of 60° or smaller, i.e. $\alpha <= 60°$. Also, a rear side 34 of the air duct 17 is curved at an end section 38. Thus, the cooling air C is discharged from the air outlet 31 with a respective inclination angle. This inclination angle, however, is generally smaller than the inclination angle $\alpha$ of the air outlet 31, e.g. less than 25°, in particular less than 10°. Also, the inclination angle of the cooling air C at the air outlet 31 is decreasing farther from the end section 38 or nearer to the side panel 19.

Therefore, the inclination angle α mostly causes the effect that the flow of cooling air C is narrower than the air outlet 31, i.e. more concentrated towards the left side panel 19. Therefore, the flow of cooling air C can pass a gap between the drum 3 at its largest width L and the left side panel 19 without significantly hitting the drum 3 and/or disturbing a layer of warm air around the drum 3. Hence, energy efficiency is improved.

However, the inclination angle α of the air outlet 31 towards the left side panel 19 α is not so large that it causes a noisy vibration of the left side panel 19. Also, it is so small that there is created a substantially laminar flow of cooling air C that is pointed upwards and that is flowing essentially parallel to the left side panel 19.

After having passed the gap, cooling air C can be discharged out of the body 2 through the air discharge openings 16 in the rear panel 20. The drum 3 acts as a barrier and prevents strong currents of oxygen-rich air flowing from the region of the body 2 above the drum 3 towards the base unit 22. Further noise generation is also prevented by the fact that a cross-sectional area of the air outlet 31 of the air duct 17 is equal or greater than a cross-sectional area of the air inlet 30 of the air duct 17.

The air duct 17 may e.g. be a one-piece element or is a preassembled, multiple-piece element. The air duct is preferably made of plastic, e.g. made by die casting.

Of course, the present application is not limited to the shown embodiments.

What is claimed is:

1. A laundry dryer, comprising:

a body having a front panel, side panels, and a rear panel defining an interior space, the rear panel having air discharge openings in an upper region thereof;

a drum arranged in the body;

a heat exchanger to condense process air from the drum, the heat exchanger being arranged in the body below the drum, and having a cooling air inlet to receive ambient air outside of the body, and a cooling air outlet through which air is discharged from the heat exchanger; and an air duct arranged in the interior space of the body to direct the cooling air substantially parallel along an adjacent one of the side panels, the air duct having:

a front side, a rear side curved at an end section thereof, a bottom side, an air duct inlet at the bottom side, and from which protrudes a clip and a plate to attach the air duct to the cooling air outlet and guide the air discharged from the cooling air outlet to the air discharge openings, and an air duct outlet positioned above the heat exchanger and inclined towards the adjacent one of the side panels, the air duct outlet having a series of vertically aligned slots to discharge cooling air in an upward direction into the body between the drum and the adjacent one of the side panels.

2. The laundry dryer of claim 1, wherein the air duct has an effective height to guide the air a predetermined distance in the upward direction, and is laterally closed along the effective height.

3. The laundry dryer of claim 2, wherein the predetermined distance is about 220 mm.

4. The laundry dryer of claim 1, wherein the vertically aligned slots are inclined towards the body at a predetermined inclination angle.

5. The laundry dryer of claim 4, wherein the predetermined inclination angle is less than or equal to 60°.

6. The laundry dryer of claim 1, wherein the air duct outlet is inclined towards the body by a predetermined inclination angle.

7. The laundry dryer of claim 6, wherein the predetermined inclination angle is less than or equal to 60°.

8. The laundry dryer of claim 1, wherein the rear side of the air duct is curved at the end section thereof to permit discharge of the air from the air duct outlet at a predetermined inclination angle.

9. The laundry dryer of claim 8, wherein the predetermined inclination angle is less than 10°.

10. The laundry dryer of claim 1, wherein the air duct outlet is arranged between the drum and a side panel of the body below a largest width of the drum.

11. The laundry dryer of claim 10, wherein the air discharge openings are located above the largest width of the drum.

12. A front-loading laundry dryer, comprising:

a body having a front panel, side panels, and a rear panel having air discharge openings in an upper region thereof;

a drum arranged in the body;

a heat exchanger to condense process air from the drum, the heat exchanger having a cooling air inlet to receive ambient air outside of the body, and a cooling air outlet through which air is discharged from the heat exchanger; and an air duct arranged in the body between the drum and an adjacent one of the side panels to direct the cooling air substantially parallel along the adjacent one of the side panels, the air duct having:

a front side, a rear side, a bottom side, an air duct inlet at the bottom side, and from which protrudes a clip and a plate to attach the air duct to the cooling air outlet and guide the air discharged from the cooling air outlet to the air discharge openings, and an air duct outlet positioned above the heat exchanger and inclined towards an adjacent one of the side panels, the air duct outlet having a series of vertically aligned slots to discharge cooling air in an upward direction between the drum and the adjacent one of the side panels.

13. A laundry dryer, comprising:

a body having a front panel, side panels, and a rear panel having air discharge openings in an upper region thereof;

a drum arranged in the body;

a process air channel to re-circulate process air to and from the drum;

a heat exchanger to condense the process air from the drum, the heat exchanger having a cooling air inlet to receive ambient air outside of the body, and a cooling air outlet through which air is discharged from the heat exchanger; and an air duct arranged in the body between the drum and an adjacent one of the side panels to direct the cooling air substantially parallel along the adjacent one of the side panels, the air duct having:

a front side, a rear side, a bottom side, an air duct inlet at the bottom side, and from which protrudes a clip and a plate to attach the air duct to the cooling air outlet and guide the air discharged from the cooling air outlet to the air discharge openings, and an air duct outlet inclined towards an adjacent one of the side panels, the air duct outlet having a series of vertically aligned slots to discharge cooling air in an upward direction between the drum and the adjacent one of the side panels.

* * * * *